US008813837B2

(12) United States Patent
Gette et al.

(10) Patent No.: US 8,813,837 B2
(45) Date of Patent: Aug. 26, 2014

(54) WELLHEAD SYSTEM HAVING RESILIENT DEVICE TO ACTUATE A LOAD MEMBER AND ENABLE AN OVER-PULL TEST OF THE LOAD MEMBER

(75) Inventors: Nicholas P. Gette, Houston, TX (US); Daniel W. Fish, Houston, TX (US); Sean P. Thomas, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 454 days.

(21) Appl. No.: 12/415,198

(22) Filed: Mar. 31, 2009

(65) Prior Publication Data

US 2010/0243238 A1 Sep. 30, 2010

(51) Int. Cl.
*E21B 19/00* (2006.01)
*E21B 33/04* (2006.01)

(52) U.S. Cl.
CPC ..... *E21B 33/04* (2013.01); *E21B 33/0422* (2013.01)
USPC ..... 166/82.1; 166/83.1; 166/84.1; 166/75.14

(58) Field of Classification Search
CPC ..... E21B 33/04; E21B 33/0422; E21B 33/03; E21B 33/0415
USPC ..... 166/82.1, 83.1, 84.1, 75.14
See application file for complete search history.

(56) References Cited

U.S. PATENT DOCUMENTS

| | | | | | |
|---|---|---|---|---|---|
| 4,460,042 | A | | 7/1984 | Galle, Jr. | |
| 4,528,738 | A | | 7/1985 | Galle, Jr. | |
| 4,569,404 | A | * | 2/1986 | Milberger et al. | 166/208 |
| 4,842,061 | A | * | 6/1989 | Nobileau | 166/115 |
| 4,978,147 | A | * | 12/1990 | Henderson et al. | 285/2 |
| 6,978,839 | B2 | * | 12/2005 | Fenton et al. | 166/348 |
| 7,040,407 | B2 | | 5/2006 | Jennings et al. | |
| 7,150,323 | B2 | * | 12/2006 | Ford | 166/348 |
| 7,380,607 | B2 | * | 6/2008 | Thomas | 166/348 |
| 7,762,319 | B2 | * | 7/2010 | Nelson | 166/84.1 |
| 7,861,789 | B2 | * | 1/2011 | Nelson | 166/348 |
| 7,900,706 | B2 | * | 3/2011 | Ford | 166/348 |
| 8,500,127 | B2 | * | 8/2013 | Gette | 277/338 |
| 2005/0274526 | A1 | * | 12/2005 | Thomas | 166/348 |
| 2006/0016604 | A1 | * | 1/2006 | Ford | 166/348 |
| 2006/0231248 | A1 | * | 10/2006 | Ford | 166/89.1 |
| 2010/0038089 | A1 | * | 2/2010 | Gette et al. | 166/338 |
| 2012/0025470 | A1 | * | 2/2012 | Gette | 277/312 |
| 2013/0068466 | A1 | * | 3/2013 | Ghumre et al. | 166/348 |

OTHER PUBLICATIONS

Office Action and Search Report dated Sep. 13, 2013 from corresponding MY Application No. PI 2010001253.

* cited by examiner

*Primary Examiner* — Jennifer H Gay
*Assistant Examiner* — Elizabeth Gitlin
(74) *Attorney, Agent, or Firm* — Bracewell & Giuliani LLP

(57) ABSTRACT

A wellbore system comprising a housing assembly and a hanger assembly. The hanger assembly comprises an actuation member that interacts with a portion of the housing assembly when the hanger assembly is positioned at a desired location in the housing assembly. The hanger assembly also comprises a load member that is adapted to extend between the hanger assembly and the housing assembly to enable the housing assembly to support the hanger assembly. The load member is carried into the wellbore in a retracted position. When the actuation member interacts with the housing assembly at the desired location, the actuation member actuates the load member to expand outward to extend between the hanger assembly and the housing assembly. The actuation member is adapted to transfer a lifting force from the surface to the load member to enable an over-pull test of the hanger assembly to be performed.

22 Claims, 11 Drawing Sheets

WELLHEAD SYSTEM HAVING RESILIENT DEVICE TO ACTUATE A LOAD MEMBER AND ENABLE AN OVER-PULL TEST OF THE LOAD MEMBER

BACKGROUND

The invention relates generally to a tubular housing used to support an object within the hollow interior of the tubular housing. In particular, the invention relates to a system having a tubular housing, such as a wellhead, to support an assembly, such as a casing hanger, within the tubular housing via a load member that is actuated to extend between the housing and the assembly.

In the oil and gas industry, pipes and tubing are used to transport oil and/or gas. In a well, pipe and/or tubing may be supported by a tubular housing. For example, a wellhead and a casing hanger disposed within the wellhead may be used to support pipe, known as casing, within a wellbore. Casing is strong steel pipe that is used in an oil and gas well to ensure a pressure-tight connection from the surface to the oil and/or gas reservoir. However, casing can be used to serve many purposes in a well. For example, the casing can be used to protect the wellbore from a cave-in or from being washed out. The casing can also be used to confine production to the wellbore, so that water does not intrude into the wellbore from a surrounding formation or, conversely, so that drilling mud does not intrude into the surrounding formation from the wellbore. The casing can also provide an anchor for the components of the well.

Several sections of casing joined together end-to-end are known as a "casing string." Because casing serves several different purposes in a well, it is typical to install more than one casing string in a well. Casing strings typically are run in a concentric arrangement, similar to an upside-down wedding cake, with each casing string extending further downward into the ground as the center of the arrangement of concentric casing strings is approached. For example, the casing string with the greatest diameter typically is the outermost casing string and the shortest, while the casing string with the smallest diameter typically is at the center and extends the deepest.

The casing hanger typically supports the casing string from a wellhead or a similar structure located near the seafloor. The casing hanger rests on a landing shoulder inside the wellhead. Multiple casing hangers may supported within a single wellhead. However, another method that may be used to support a casing hanger, rather than by using a shoulder of the wellhead, is to use a load ring to support the casing hanger. The load ring may be actuated to extend between the casing hanger and a recess in the wellhead to support the casing hanger.

Unfortunately, problems may occur when engaging the load ring and installing the seal. For example, the load ring may not properly engage the wellhead. Furthermore, subsea oil and gas wells are being developed at ever increasing seawater depths. These greater ocean depths make it difficult for an operator on the surface to obtain a positive indication that a load ring, or any other such device, has been actuated in a subsea well.

Therefore, an improved technique for actuating a device in a subsea well is desired. The techniques described below may solve one or more of the problems described above.

BRIEF DESCRIPTION

A wellbore system comprising a housing assembly and a hanger assembly. The hanger assembly comprises an actuation member that interacts with a portion of the housing assembly when the hanger assembly is positioned at a desired location in the housing assembly. The hanger assembly also comprises a load member that is adapted to extend between the hanger assembly and the housing assembly to enable the housing assembly to support the hanger assembly. The load member is carried into the wellbore in a retracted position. When the actuation member interacts with the housing assembly at the desired location, the actuation member actuates the load member to expand outward to extend between the hanger assembly and the housing assembly. The actuation member is adapted to transfer a lifting force from the surface to the load member to enable an over-pull test of the hanger assembly to be performed.

DRAWINGS

These and other features, aspects, and advantages of the present invention will become better understood when the following detailed description is read with reference to the accompanying drawings in which like characters represent like parts throughout the drawings, wherein:

FIG. 7 is a cross-sectional view of the casing hanger disposed in the wellhead as a load shoulder of an actuation member lands on a tag shoulder of the wellhead, in accordance with an exemplary embodiment of the present technique;

FIG. 8 is a detailed cross-sectional view of the casing hanger disposed in the wellhead as the load shoulder of the actuation member lands on the tag shoulder of the wellhead, in accordance with an exemplary embodiment of the present technique;

FIG. 9 is a cross-sectional view of the casing hanger disposed in the wellhead after the actuation member has been elastically deformed by the weight of the casing hanger string and the casing hanger has moved axially relative to the actuation member and, thereby, actuated a load ring, in accordance with an exemplary embodiment of the present technique;

FIG. 10 is a detailed cross-sectional view of the actuation member, casing hanger, and wellhead, taken generally along line 10-10 of FIG. 9, in accordance with an exemplary embodiment of the present technique.

DETAILED DESCRIPTION

Figure 1:
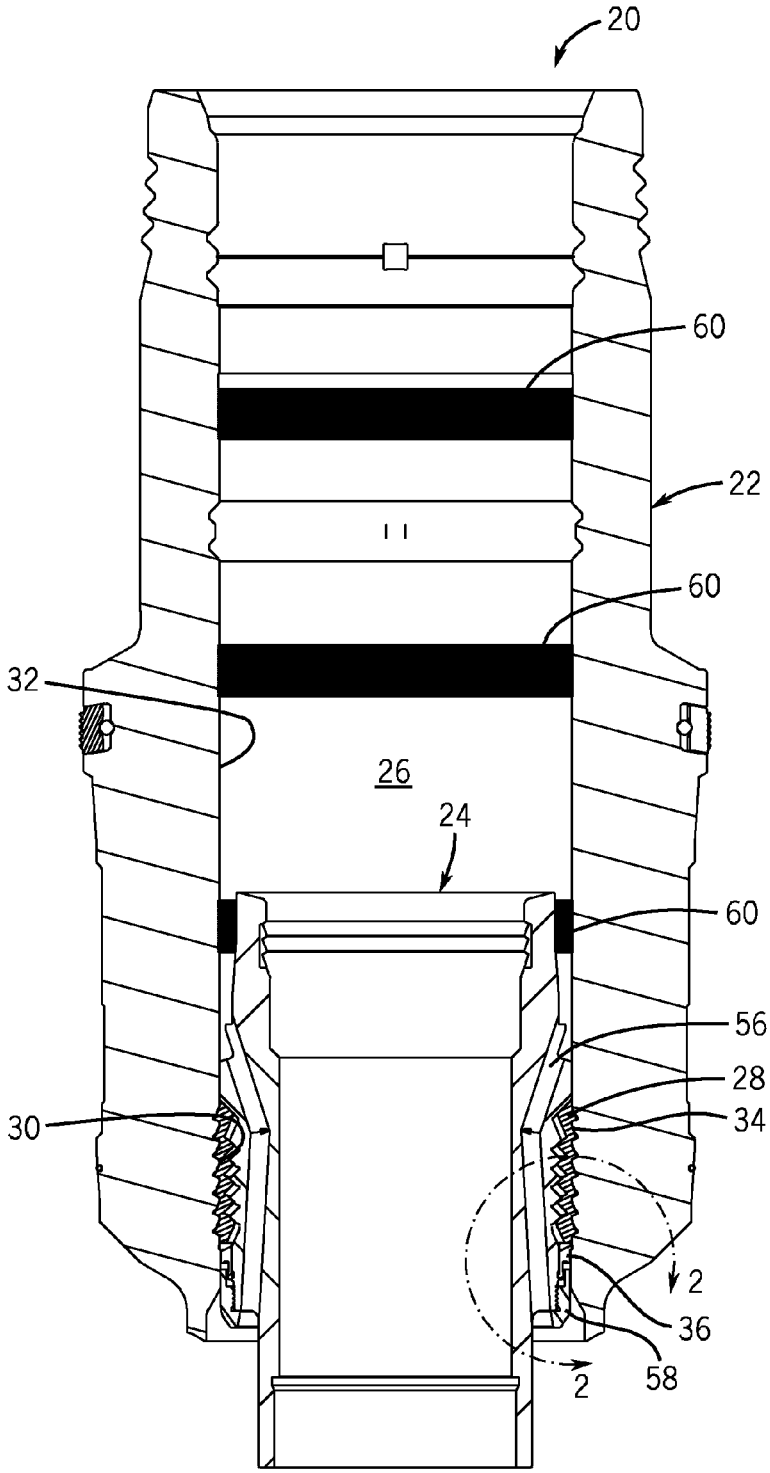
FIG. 1 is a cross-sectional view of a wellhead system comprises a casing hanger installed within a high pressure wellhead, in accordance with an exemplary embodiment of the present technique.

Referring now to FIG. 1, the present invention will be described as it might be applied in conjunction with a technique for supporting a first device within the hollow interior of a second device. In the illustrated embodiment, the technique is used in a wellhead system, as represented generally by reference numeral 20, comprising a high pressure wellhead 22 and a casing hanger assembly 24. However, the technique may be used in systems other than a wellhead system. A string of casing (not shown) is connected to bottom of the casing hanger assembly 24. The casing hanger assembly 24 and casing string are lowered into a bore 26 of the high pressure wellhead 22 by a setting tool (not shown). The setting tool is supported by a string of pipe extending from a derrick or crane located on a platform, such as a drilling ship. Instruments on the surface provide an operator with an indication of the weight supported by the derrick or crane, i.e., the weight of the casing, casing hanger, and the string of pipe supported from the surface.

Figure 2:
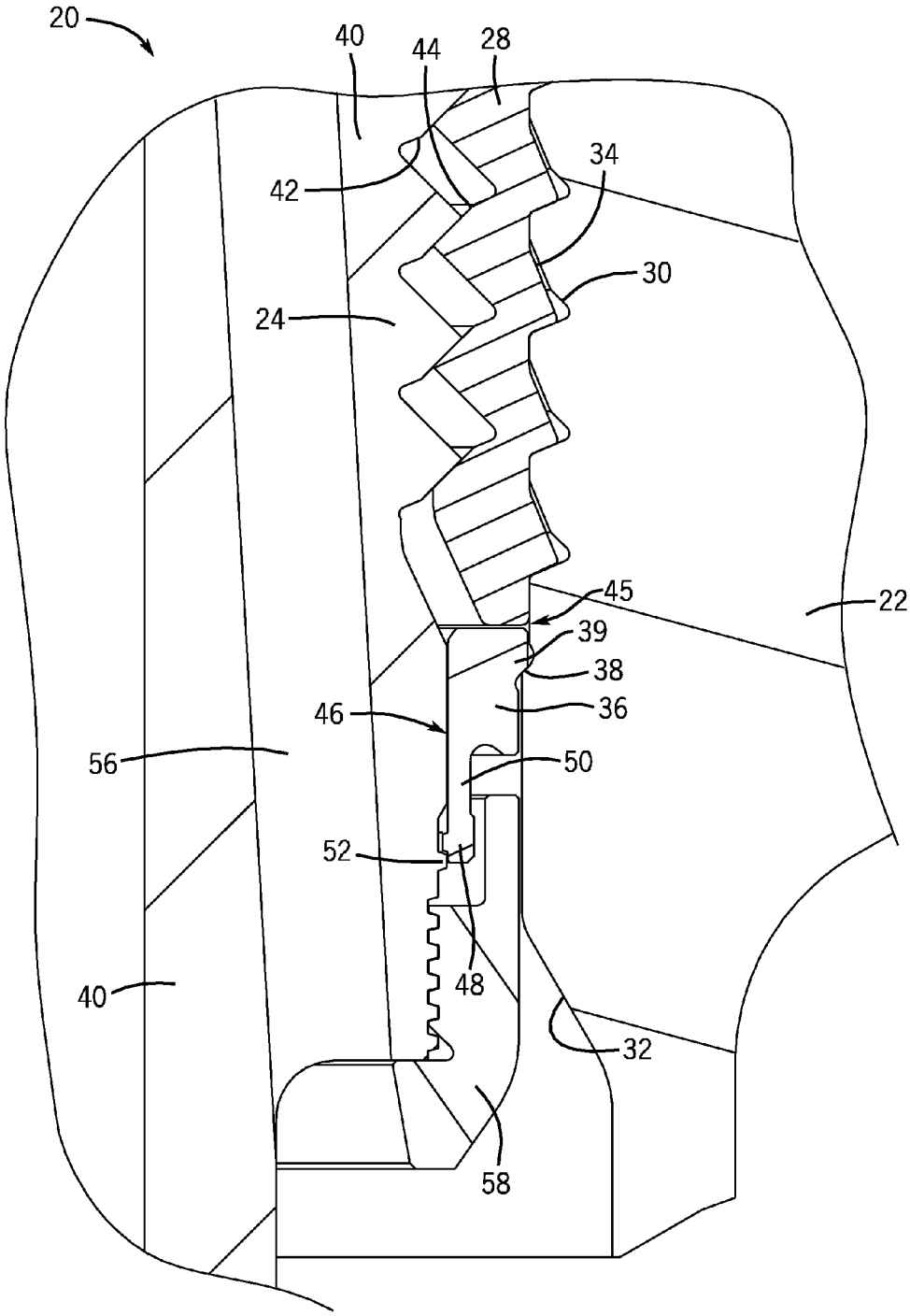
FIG. 2 is a detailed cross-sectional view of a portion of the wellhead system, taken generally along line 2-2 of FIG. 1, in accordance with an exemplary embodiment of the present technique.

Referring generally to FIGS. 1 and 2, the casing hanger assembly 24 is supported in the high pressure wellhead 22 by engagement between a load member 28 and the high pressure wellhead 22. In particular, engagement between the load member 28 and an opposite portion 30 of the surface profile 32 of the bore 26 of the high pressure wellhead 22. In the illustrated embodiment, the load member 28 is an inwardly-biased expandable ring, such as a C-ring, that is carried by the casing hanger assembly 24 into the wellhead 22. However, the load member 28 may be an outwardly-biased ring held in place by shear pins or a series of dogs disposed around the casing hanger assembly. The outer surface of the load member 28 has a toothed profile 34 in this embodiment. In addition, the opposite portion 30 of the surface profile of the high pressure wellhead 22 has a corresponding toothed profile so that it can receive and support the toothed profile 34 of the load member 28. However, profiles other than a toothed profile may be used by the load member 28 and the wellhead 22.

In the illustrated embodiment, the expansion of the load member 28 into engagement with the surface profile 32 of the high pressure wellhead 22 is actuated by engagement between an actuation member 36 carried by the casing hanger assembly 24 and a portion 38 of the high pressure wellhead 22. In this embodiment, the actuation member 36 is a ring that is disposed around the casing hanger assembly 24. However, the actuation member 36 may be several devices spaced around the circumference of the casing hanger assembly 24. In this embodiment, the portion 38 of the high pressure wellhead 22 that engages the actuation member 36 is a tag shoulder 38. In the illustrated embodiment, downward movement of the actuation member 36 is blocked by the tag shoulder 38 in the surface profile 32 of the bore 26 of the high pressure wellhead 22. However, another type of device or member may be used to engage the actuation member 36. In the illustrated embodiment, the tag shoulder 38 is contacted by a shoulder 39 of the actuation member 36.

The load member 28 is expanded outward by lowering the main body 40 of the casing hanger assembly 24 with the actuation member 36 blocked by the tag shoulder 38 of the high pressure wellhead 22. The main body 40 of the casing hanger assembly 24 has angled surfaces 42 on the outer circumference of the casing hanger assembly 24 opposite corresponding angled surfaces 44 on the inner circumference of the load member 28. These angled surfaces 42, 44 create a mechanical advantage that urges the load member 28 outward, and slightly upward, when there is relative movement between the main body 40 of the casing hanger assembly 24 and the load member 28. The slight upward movement of the load member 28 produces a gap 45 between the load member 28 and the actuation member 36 in this embodiment.

The actuation member 36 has an elastically-deformable portion 46 that blocks relative movement of the main body of the casing hanger assembly in a first direction relative to the actuation member 36 during the process of lowering the casing hanger assembly 24 into the wellhead 22 from the surface. In this embodiment, the elastically-deformable portion 46 of the actuation member 36 comprises an inward-facing protrusion 48 located on an extension 50. The main body 40 of the casing hanger assembly 24 has a corresponding outward-facing protrusion 52. As will be discussed in more detail below, engagement between the inward-facing protrusion 48 of the actuation member 36 and the outward-facing protrusion 52 on the main body 40 of the casing hanger assembly 24 causes the actuation member 36 to be urged upward to drive the load member 28 outward when a lifting force is applied to the casing hanger assembly 24 during an over-pull test to ensure that the load member 28 is engaged with the wellhead 22.

The wellhead system 20 has a number of other features. For example, the casing hanger assembly 24 has a series of ports 56 that extend around the main body 40 of the casing hanger assembly 24 to enable well fluids and/or cement to pass upward through the casing hanger assembly 24. In addition, the casing hanger assembly 24 also has a nose ring 58 that is used to guide and centralize the casing hanger assembly 24 through the bore 26 of the wellhead 22. Finally, the wellhead 22 has several sets of wickers 60 that may be used to form seals with corresponding wickers on casing hanger seal assemblies.

Figure 3:
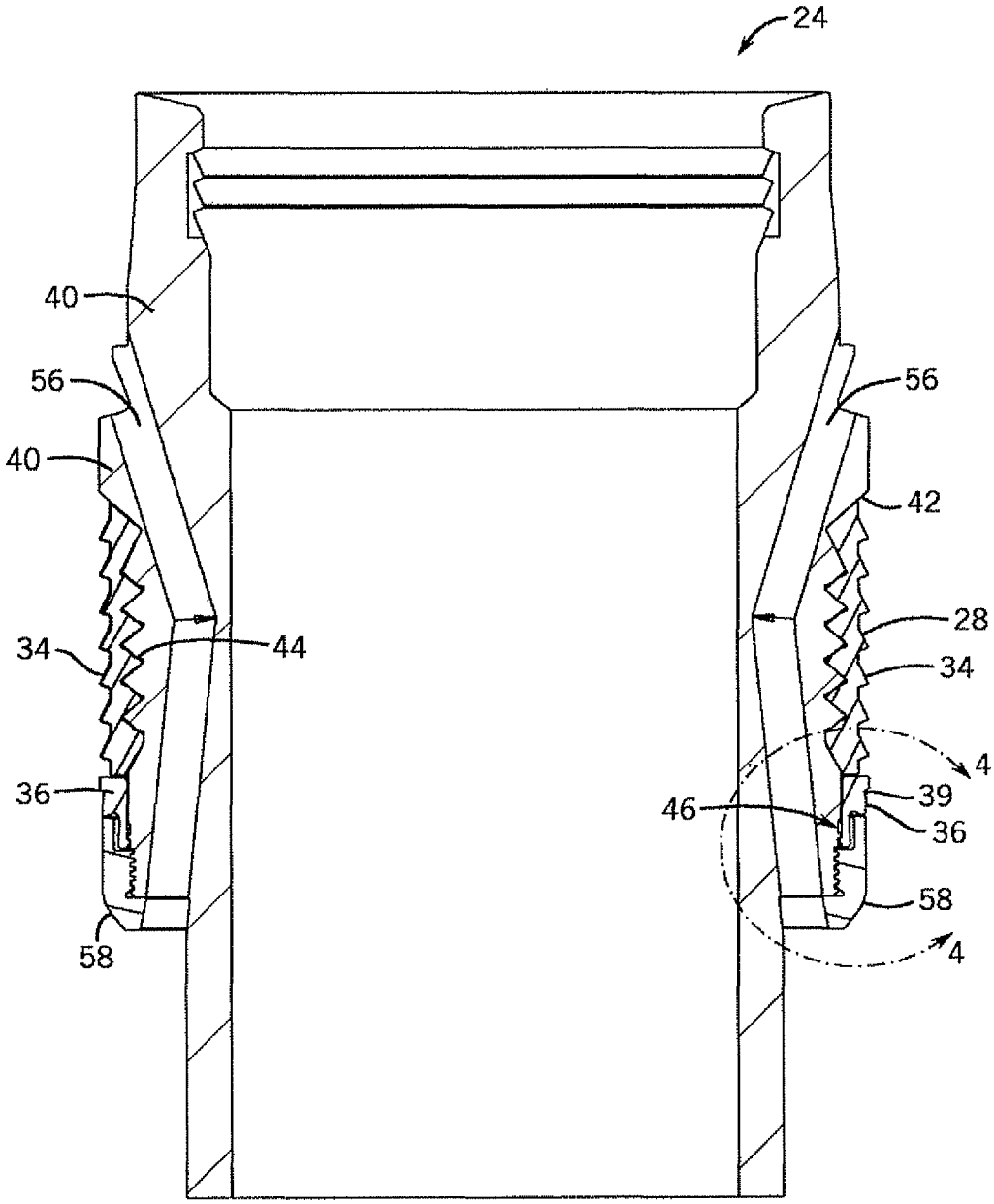
FIG. 3 is a cross-sectional view of the casing hanger of FIG. 1, in accordance with an exemplary embodiment of the present technique.
Figure 4:
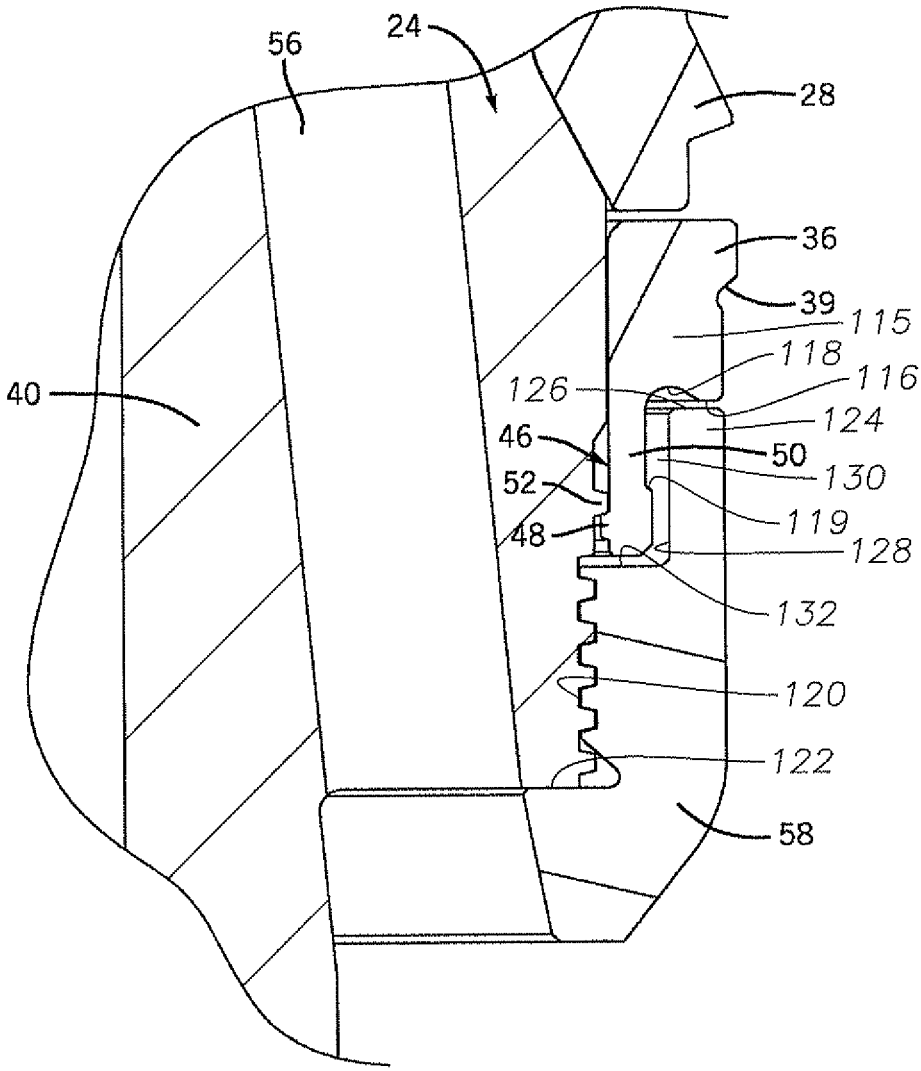
FIG. 4 is a detailed cross-sectional view of a portion of the casing hanger, taken generally along line 4-4 of FIG. 3, in accordance with an exemplary embodiment of the present technique.

Referring generally to FIGS. 3 and 4, an exemplary embodiment of a casing hanger assembly 24 is presented. As noted above, the load member 28 initially is maintained in a retracted position to minimize inadvertent engagement with other wellhead components, which might cause the casing hanger assembly 24 to land in the wrong place. In addition, the actuation member 36 is carried on the casing hanger assembly 24 with the actuation member 36 oriented so that the actuation member protrusion 48 is positioned below the casing hanger protrusion 52. This orientation enables the actuation member 36 to support the main body 40 of the casing hanger assembly 24 after the actuation member 36 engages the tag shoulder 38 of the wellhead 22.

Referring to FIG. 4, actuator member 36 has an upper portion 115 radially thicker than extension or leg 50. Extension 50 extends downward from the inner diameter of upper portion 115. A downward facing shoulder 116 is on the lower end of upper portion and is in a plane perpendicular to the axis of hanger body 40. A curved recess or fillet 118 joins downward facing shoulder 116 with the outer diameter of extension 50. Fillet 118 is curved in the cross-sectional view shown in FIG. 4 and has an upper extremity that is at an elevation above downward facing shoulder 116. The outer surface of extension 50 has an upward facing lip 119. The portion of extension above lip 119 has less radial thickness than the portion below lip 119.

Nose or retainer ring 58 has internal threads 120 that secure nose ring 58 to external threads on hanger body 40. Nose ring 58 has an internal shoulder 122 that abuts a downward facing adjacent ports 56. Nose ring 58 has an upward extending cylindrical wall 124 with a rim 126 shown spaced slightly below downward facing shoulder 116. Rim 126 would engage downward facing shoulder if actuator member 36 moved downward during run-in relative to hanger body 40. Cylindrical wall 124 has an inner diameter 128 greater than an exterior of hanger body 40, defining an annular cavity 130. Inner diameter 128 is also greater than the inner diameter of nose ring 58 at threads 120. Extension 50 is located in cavity 130 during run-in, as in FIG. 4 and after setting, as in FIG. 3. An upward facing shoulder 132 extends from a base of cylindrical wall 124 at inner diameter 128 to threads 120. Upward facing shoulder 132 is closely spaced to the lower end of extension 50 during run-in. After setting, the spacing increases, as shown in FIG. 3.

Figure 5:
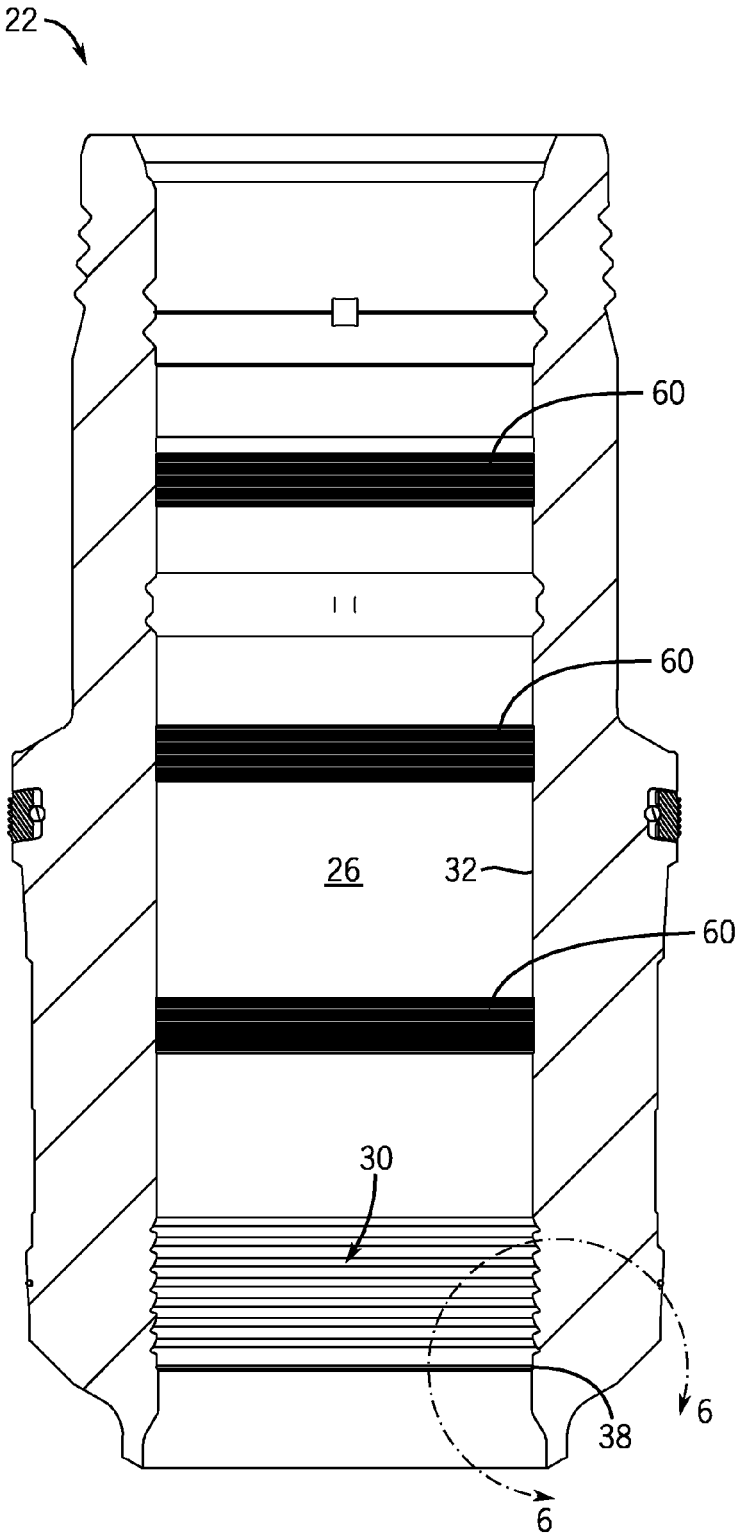
FIG. 5 is a cross-sectional view of the wellhead of FIG. 1, in accordance with an exemplary embodiment of the present technique.
Figure 6:
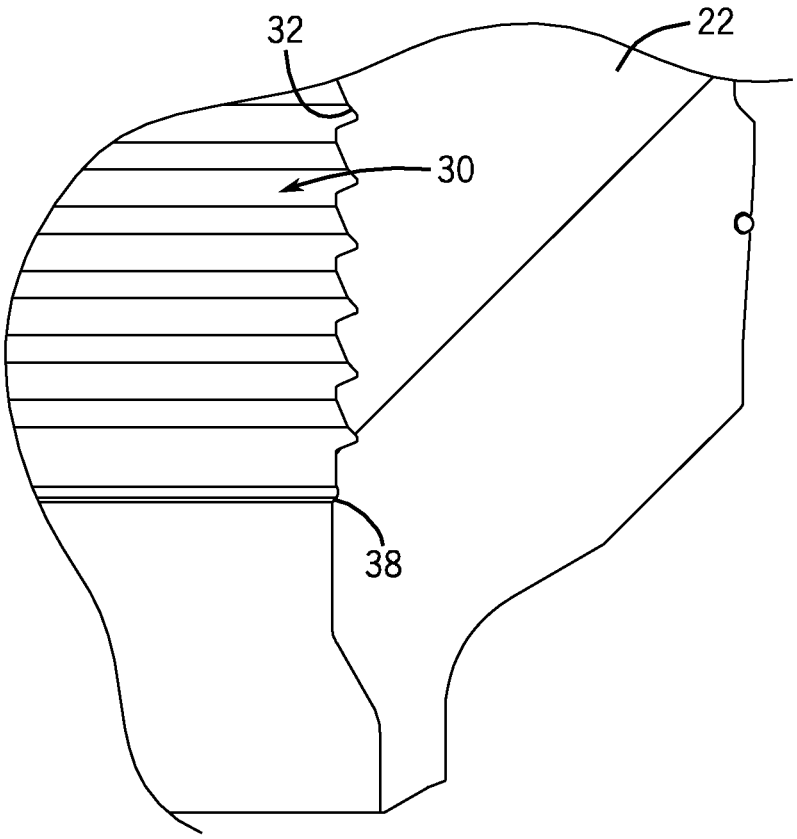
FIG. 6 is a detailed cross-sectional view of a portion of the wellhead system, taken generally along line 6-6 of FIG. 5, in accordance with an exemplary embodiment of the present technique.

Referring generally to FIGS. 5 and 6, an exemplary embodiment of the wellhead 22 is presented. The toothed portion 30 of the surface profile 32 of the wellhead 22 and the wickers 60 are illustrated in FIG. 5. In addition, tag shoulder 38 is illustrated in FIG. 6.

Referring generally to FIGS. 7-10, the process for installing the casing hanger assembly 24 in the wellhead 22 is presented. As noted above, a setting tool supported by a string of pipe extending from the surface may be used to lower the casing hanger assembly 24 and casing string into the wellhead 22.

Figure 7:
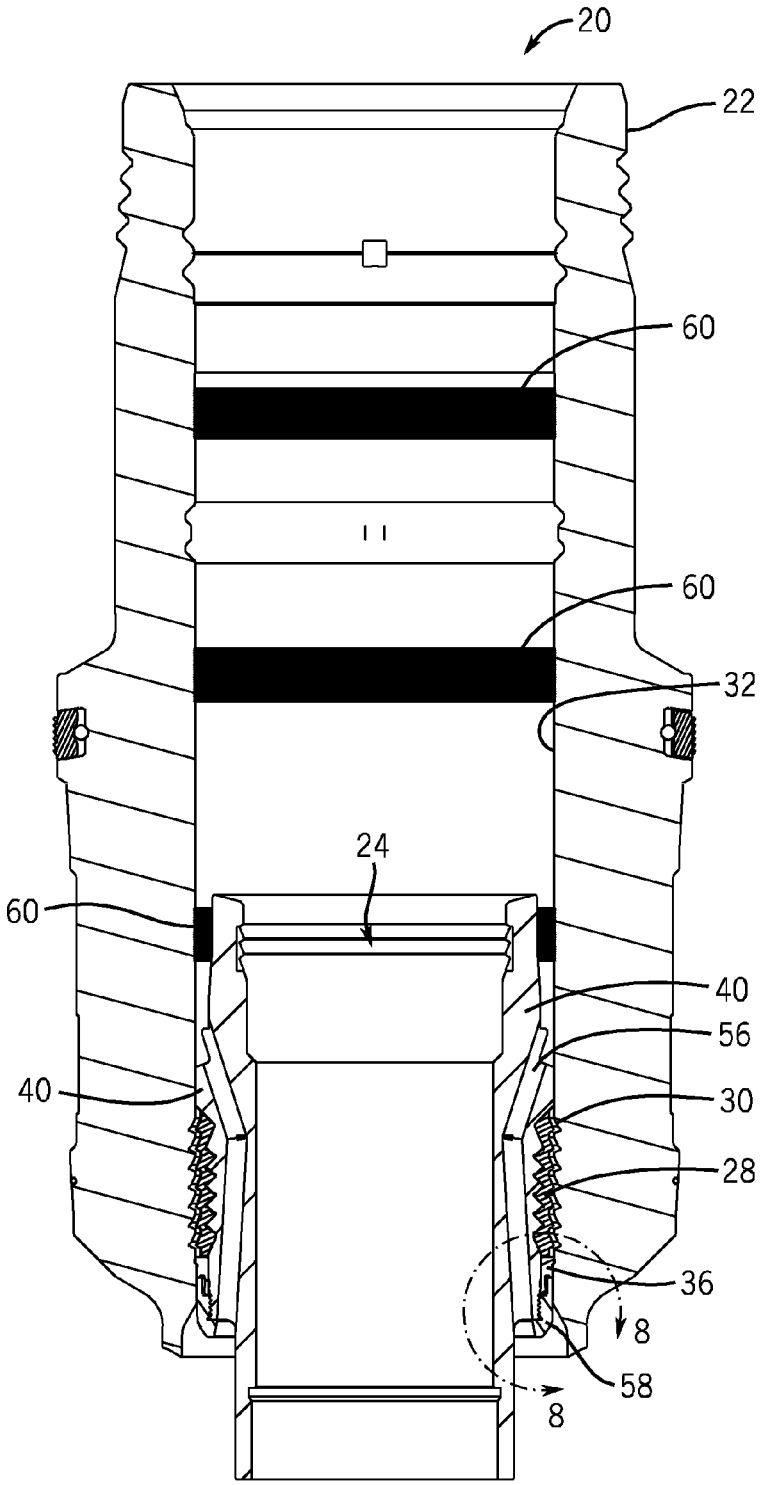
FIGS. 7-10 are a series of Figures illustrating the installation of the casing hanger into the wellhead; in accordance with an exemplary embodiment of the present technique.
Figure 8:
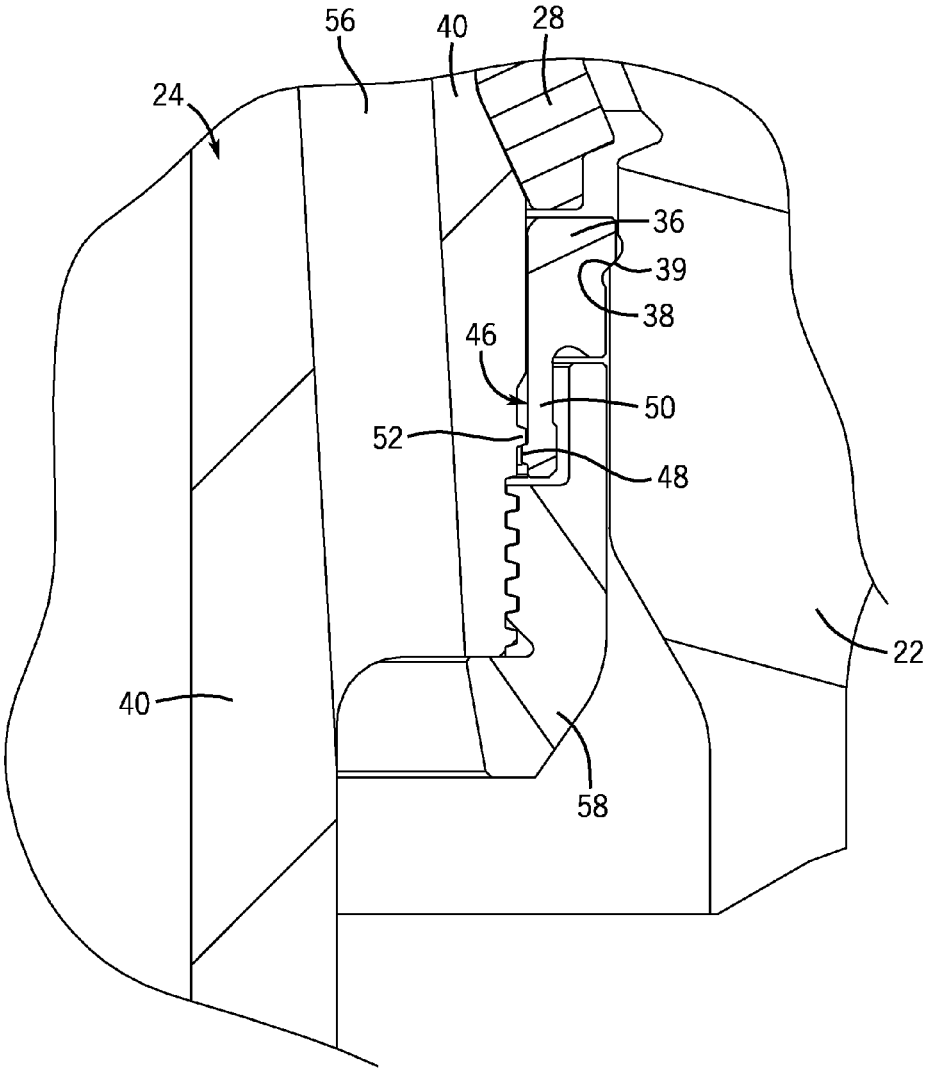

Referring generally to FIGS. 7 and 8, initially, the casing hanger assembly 24 is lowered from the surface into the wellhead 22. Eventually, the actuation member 36 engages the wellhead 22 at a desired location in the wellhead 22. In this embodiment, the engagement is comprised of landing the actuation member 36 on the tag shoulder 38 of the wellhead 22. At this point of the installation process, the actuation member protrusion 48 of the actuation member 36 is oriented below the casing hanger protrusion 52. This orientation enables the actuation member protrusion 48 of the actuation member 36 to support the casing hanger protrusion 52 of the casing hanger assembly 24 when the actuation member 36 is landed on the tag shoulder 38 of the wellhead 22. A reduction in the weight on the string of pipe will be indicated on the surface.

Figure 9:
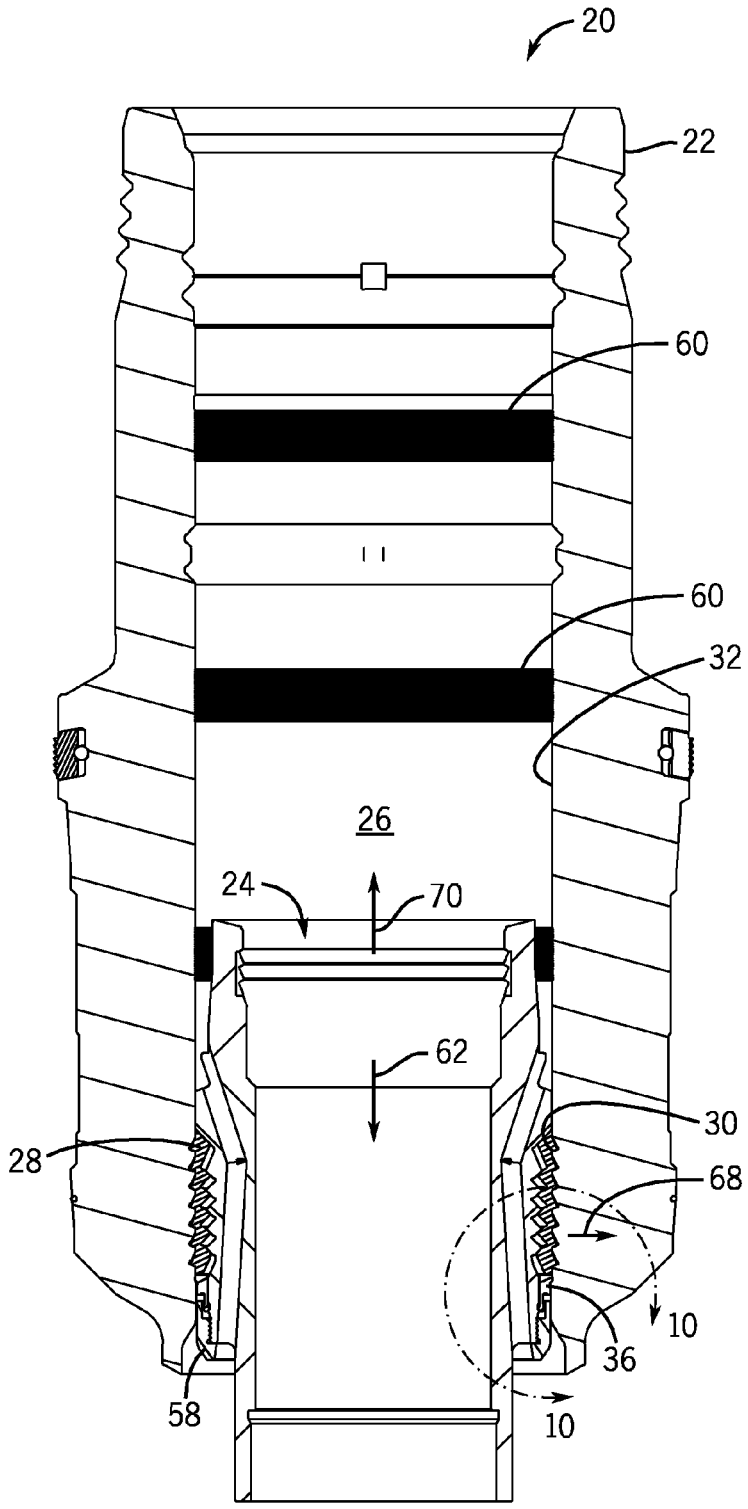
Figure 10:
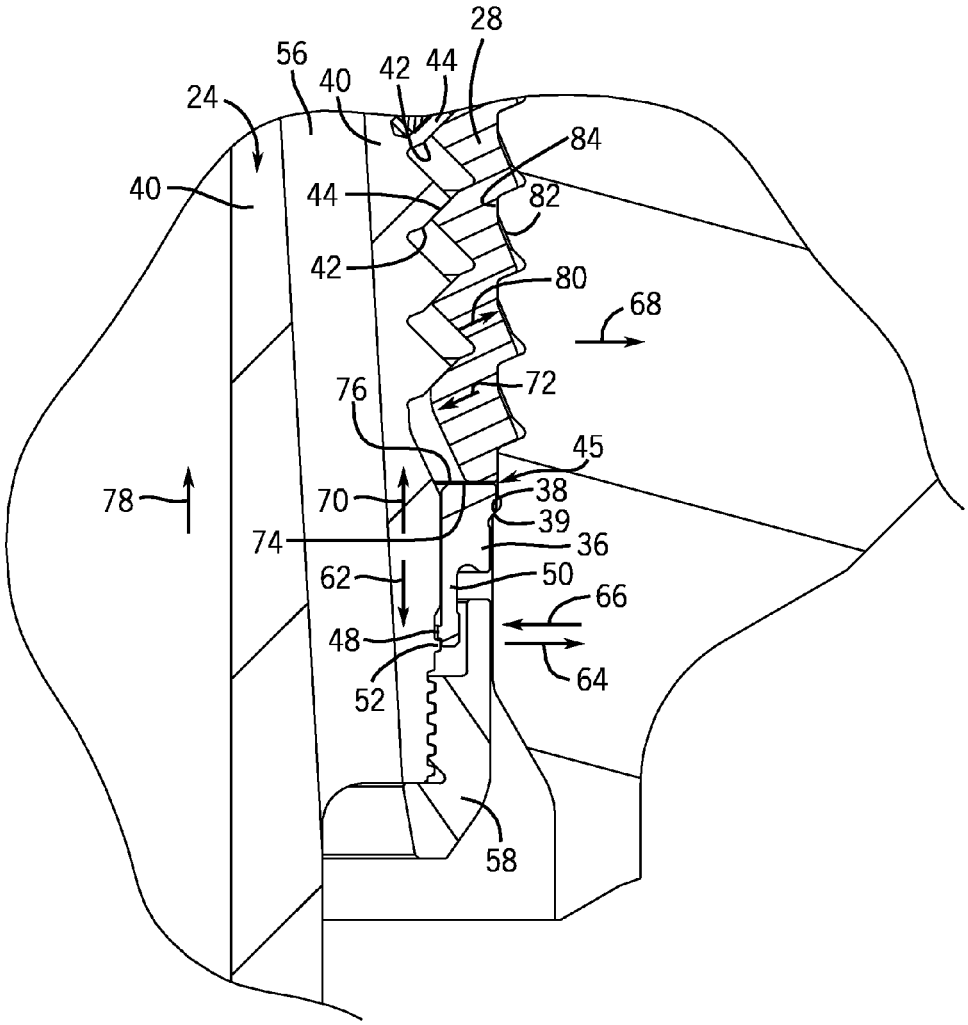

Referring generally to FIGS. 9 and 10, additional weight is transferred from the surface to the wellhead 22 as the operator attempts to lower the casing hanger assembly 24 further into the wellhead 22. The additional weight is transmitted to the actuation member protrusion 48 by the casing hanger protrusion 52. Eventually, the additional weight supported by the actuation member 36 causes the elastically-deformable portion 46 of the actuation member 36 to deform. In this embodiment, the extension 50 of the actuation member 36 is deformed radially outward, as represented by arrow 64. The deformation of the elastically-deformable portion 46 of the actuation member 36 removes the actuation member protrusion 48 as an impediment to axial movement of the casing hanger protrusion 52 and, therefore, the main body 40 of the casing hanger assembly 24. As a result, the main body 40 of the casing hanger assembly 24 is lowered further into the wellhead 22, as represented generally by reference numeral 62. Eventually, the casing hanger protrusion 52 is lowered below the actuation member protrusion 48, enabling the extension 50 to return the actuation member protrusion 48 to its un-deformed position, as represented by arrow 66. At this point of the installation process, now the actuation member protrusion 48 of the actuation member 36 is oriented above the casing hanger protrusion 52.

In the illustrated embodiment, the casing hanger protrusion 52 and the actuation member protrusion 48 are configured so that the elastically-deformable portion 46 deforms when the elastically-deformed portion 46 supports a defined weight. For example, the bottom surface of the casing hanger protrusion 52 and the top surface of the actuation member protrusion 48 are angled to enable the actuation member protrusion 48 to support the casing hanger protrusion 52, but also to enable sliding engagement between the two surfaces as the actuation member extension 50 is deflected outward. Similarly, the length of the extension 50 may be established so that the elastically-deformable portion 46 deforms when the elastically-deformed portion 46 supports a defined weight. In addition, the material composition of the actuation member 46 may be selected so that the elastically-deformable portion 46 deforms when the elastically-deformed portion 46 supports a defined weight.

As the operator attempts to lower the casing hanger assembly 24 further into the wellhead 22, the load member 28 is driven against the actuation member 36. Because downward movement of the load member 28 is opposed by the actuation member 36, the angled surfaces 42, 44 of the casing hanger 24 and load member 28 produce a mechanical advantage that urges the load member 28 outward, as represented by arrow 68. In this view, the load member 28 has been driven outward into engagement with the surface profile 32 of the bore 26 of the wellhead 22. The toothed profile 34 of this embodiment of the load member 28 is engaged with the corresponding toothed profile 30 of this embodiment of the wellhead 22. The weight of the casing string and casing hanger assembly 24 are supported by the high pressure wellhead 22 via the load member 28. A casing hanger seal assembly may be installed to seal the annulus between the casing hanger 24 and the high pressure wellhead 22.

Before a casing hanger seal assembly is installed, it may be desired to perform an over-pull test to ensure that the load member 28 is engaged with the wellhead 22. To perform an over-pull test, a lifting force, as represented by arrow 70, is applied to the main body 40 of the casing hanger assembly 24. When the lifting force 70 is applied to lift the casing hanger assembly 24, the load member 28 retracts, as represented by arrow 72, due to its inward bias until lower surface 74 of load member 28 contacts upper surface 76 of the actuation member 36, closing gap 45. Further inward travel of the load member 28 is now restrained by contact between the actuation member protrusion 48 and the casing hanger protrusion 52. When the over-pull force exceeds total casing weight, the entire casing hanger assembly 24 will travel axially upward, as represented by arrow 78, and the load member 28 will expand outward and upward, as represented by arrow 80, until the upper surfaces 82 of the load member 28 contact the upper surfaces 84 of the load profile 30 in the wellhead bore 32. This contact will produce an opposing force to the lifting force on the casing hanger assembly 24 and reflect an increase in string weight by the operator. However, if the casing hanger assembly 24 is not properly positioned, the load member 28 will not be driven into engagement with the toothed profile 30 of the high pressure wellhead. In addition, no opposing force to the lifting force will be produced if the load member 28 is not properly positioned and the casing hanger assembly 24 will be lifted from its position in the wellhead 22.

Figure 11:
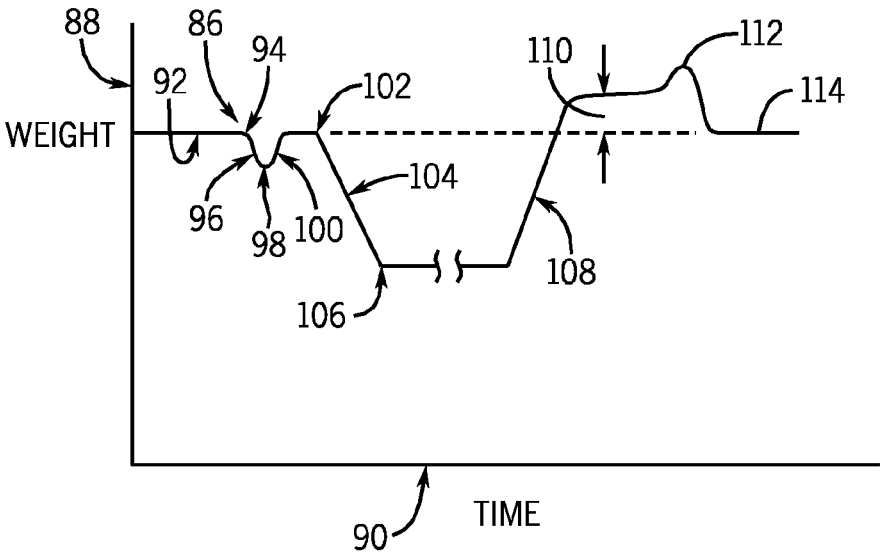
FIG. 11 is a chart of weight supported from the surface versus time, in accordance with an exemplary embodiment of the present technique.

Referring generally to FIG. 11, an exemplary embodiment of a plot 86 of weight versus time during the final portions of the installation process of the casing hanger assembly 24 is presented. In FIG. 11, the x-axis 88 represents the weight supported from the surface, such as by a pipe string supported by a derrick, and the y-axis 90 represents "time." In the first portion 92 of the plot 86, the weight supported from the surface comprises the casing string hanging from the casing hanger assembly 24, the casing hanger assembly 24, and a string of drill pipe used to lower the casing string and casing hanger assembly 24 into the wellhead 22 from the surface.

The point of the installation process where the actuation member 36 engages the tag shoulder 38 of the wellhead 22 is represented on plot 86 by arrow 94. From this point, the actuation member 36 and wellhead 22 begin to assume some of the weight of the casing string and casing hanger assembly 24. In particular, the casing hanger protrusion 52 is supported by the actuation member protrusion 48. This is reflected on the plot 86 as a reduction in the weight supported from the surface, represented generally by arrow 96.

When a defined amount of weight is supported by the actuation member 36, the elastically-deformable portion 46 of the actuation member 36 deforms. This is represented by point 98 on plot 86. In the illustrated embodiment of the actuation member 36, the extension 50 of the actuation member 36 is deformed outward, removing the actuation member protrusion 48 as support for the casing hanger protrusion 52. The weight of the casing string and casing hanger assembly 24 that had been transferred to the actuation member 36 and wellhead 22 are transferred back to the surface, as represented by arrow 100, as the main body 40 of the casing hanger assembly 24 lowers in the wellhead 22.

The point of the installation process when the load member 28 engages the wellhead 22 is represented generally by arrow 102. The weight of the casing string and casing hanger assembly 24 begins to be transferred to the wellhead 22 via the load member 28. This is represented on plot 86 generally by arrow 104 as a reduction in the weight supported from the surface. Eventually, all of the weight of the casing string and casing hanger assembly 24 is supported by the wellhead 22 via the load member 28. Thus, the weight supported from the surface is the drill string weight, represented generally by arrow 106. The setting tool may be disengaged from the casing hanger assembly 24 and returned to the surface or the tool may be used to install a casing hanger seal.

Typically, an over-pull test is performed after installation to ensure that the load member 28 has engaged the wellhead 22 and the casing hanger assembly 24 is installed within the wellhead 22. As noted above, the casing hanger protrusion 52 and the elastically-deformable portion 46 of the actuation member 36 are utilized during the over-pull test. During the over-pull test, a lifting force is applied to lift the casing hanger assembly 24. The lifting force on the casing hanger assembly 24 causes the casing hanger protrusion 52 to drive the actuation member protrusion 48 upward. This, in turn, causes the actuation member 36 to drive the load member 28 into greater engagement with the toothed profile 30 of the high pressure wellhead 22 if the casing hanger assembly 24 is properly positioned in the high pressure wellhead. The engagement of the load member 28 with the toothed profile 30 of the wellhead will produce an opposing force to the lifting force from the casing hanger assembly 24. This opposing force will be reflected on the surface as an increase in the weight supported from the surface, represented generally by arrow 108. However, if the load member 28 and the toothed profile 30 of the high pressure wellhead 22 are not engaged, the weight supported from the surface will not increase.

The casing hanger protrusion 52 and the elastically-deformable portion 46 of the actuation member 36 are configured such that a defined safe over-pull weight may be provided before the elastically-deformable portion 46 of the actuation member 36 is deformed. The safe over-pull weight represents an operating limit for the opposing force created by the engagement between the load member 28 and the wellhead 22. This safe over-pull weight is represented in region 110 of the plot 86. In the illustrated embodiment, the casing hanger protrusion 52 and the actuation member protrusion 48 are configured so that the elastically-deformable portion 46 does not deform before a desired lifting force is applied. For example, the top surface of the casing hanger protrusion 52 and the bottom surface of the actuation member protrusion 48 are angled to enable the actuation member protrusion 48 to block upward movement of the casing hanger protrusion 52.

To remove the casing hanger assembly 24 from the wellhead 22, a lifting force is applied to cause the elastically-deformable portion 46 of the actuation member 36 to deform from below. This force is represented on plot 86 at reference point 112. The casing hanger protrusion 52 is driven above the actuation member protrusion 48, which enables the load member 28 to retract into the main body 40 of the casing hanger assembly 24. The top surface of the casing hanger protrusion 52 and the bottom surface of the actuation member protrusion 48 are angled to enable sliding engagement between the two surfaces when the lifting force deflects the actuation member extension 50 outward. As a result, the weight of the casing hanger assembly 24 is transferred from the wellhead 22 to the surface via the pipe string, as represented by the portion of the plot 86 represented by arrow 114.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A wellhead system, comprising:

a first wellhead assembly having a bore with an axis and an internal profile and a tag shoulder in the bore;

a second wellhead assembly that is lowered into and landed within the bore of the first wellhead assembly, comprising:

a load member carried by the second wellhead assembly, the load member being actuable to engage the profile in the first wellhead assembly to enable the first wellhead assembly to support the second wellhead assembly;

an actuation member carried by the second wellhead assembly to move the load member into engagement with the profile, the actuation member having an outward extending actuation member shoulder landing on the tag shoulder, the actuation member having a downward extending leg and an inward-extending actuation member protrusion on the leg;

an outward extending second wellhead assembly protrusion on the second wellhead assembly, the actuation member having a run-in position wherein the second wellhead assembly protrusion is located on the actuation member protrusion, preventing downward movement of the second wellhead assembly relative to the actuation member after the actuation member has landed on the tag shoulder, until sufficient weight is applied to the second wellhead member to cause the leg to elastically deform, which moves the actuation member protrusion radially outward to allow the second wellhead assembly protrusion to slide past and below the actuation member protrusion; and a retainer ring secured to the second wellhead assembly below the actuation member to retain the actuation member on the second wellhead assembly.

2. The wellhead system as recited in claim 1, wherein the load member is resilient.

3. The wellhead system according to claim 1, wherein:
the retainer ring has an upward extending annular portion that extends around the leg of the actuation member.

4. The wellhead system according to claim 1, wherein:
the retainer ring has an upward facing shoulder located below a lower end of the leg;
a cylindrical upper portion extends upward from the upward facing shoulder, defining an annular cavity between the cylindrical upper portion and an outer surface of the second wellhead assembly; and
the leg is located within the cavity both during the run-in position and during a set position.

5. The wellhead system according to claim 4, wherein:
the upper cylindrical portion has a greater radial thickness than the leg, defining a downward facing shoulder in a plane perpendicular to the axis; and
during the run-in position, the upward facing shoulder of the retainer ring is more closely spaced to the downward facing shoulder of the actuation member than during the set position.

6. The wellhead system according to claim 5, further comprising:
a recess that is curved when viewed in cross section formed in the downward facing shoulder, the recess joining an outer surface of the leg with the downward facing shoulder of the actuation member.

7. The wellhead system according to claim 5, further comprising an upward facing lip on an outer surface of the leg above a lower end of the leg.

8. A well system, comprising:
a housing assembly;
a hanger assembly,
wherein the housing assembly and the hanger assembly are adapted to cooperate to enable the housing assembly to support the hanger assembly,
the hanger assembly comprising:
a load member adapted to be extended from the hanger assembly to the housing assembly to enable the housing assembly to support the hanger assembly;
an actuation member adapted to actuate outward movement of the load member at a desired position within the housing assembly as the hanger assembly is lowered into the housing assembly and to urge the load member outward after the load member has been extended and a downward force is applied to the hanger assembly;
a retainer ring secured to the hanger assembly, the retainer ring having an upper cylindrical portion with an inner diameter greater than an outer surface portion of the hanger assembly, defining an annular cavity between the outer surface portion of the hanger assembly and the upper cylindrical portion; and
wherein a lower portion of the actuation member extends into the cavity.

9. The well system as recited in claim 8, wherein the lower portion of the actuation member is resilient.

10. The well system as recited in claim 8, wherein the housing assembly and the actuation member are adapted to enable the housing assembly to block downward movement of the actuation member as the hanger assembly is lowered into the housing assembly.

11. The well system as recited in claim 10, wherein the actuation member is adapted to block downward movement of the load member after the housing assembly blocks downward movement of the actuation member.

12. The well system as recited in claim 11, wherein the lower portion of the actuation member comprises:
a first engagement portion;
the hanger assembly comprises a second engagement portion disposed on a hollow body;
the first and second engagement portions being adapted to cooperate to restrict downward movement of the hollow body relative to the actuation member after downward movement of the actuation member is blocked by the housing assembly.

13. The well system as recited in claim 12, wherein the lower portion of the actuation member is adapted to elastically deform to enable downward movement of the hanger assembly relative to the actuation member when the actuation member is engaged by the housing assembly and the hollow body of the hanger assembly provides a sufficient downward force to the actuation member.

14. The wellhead system as recited in claim 13, wherein the first engagement portion and the second engagement portion are adapted to cooperate to urge the actuation member upward when an upward force is applied to the hanger assembly after the load member has been actuated.

15. The wellhead system according to claim 8, wherein the retainer ring prevents substantially all axial movement of the actuator member relative to the hanger assembly while the actuator member is in a run-in position.

16. The wellhead system according to claim 15, wherein the hanger assembly moves axially relative to the actuator member when moving from the run-in position to a set position.

17. The wellhead system according to claim 16, wherein the lower portion of the actuator member is located within the cavity during the run-in position and the set position.

18. A well system, comprising:
a hanger assembly adapted to be lowered into a housing, comprising:
a body having an axis and a body rib protruding radially outward from an outer surface portion of the body;
a load member carried by the body and adapted to secure the hanger assembly in the housing;
an actuation member carried by the body, and comprising:
a cylindrical upper portion;
an actuator member shoulder on an outer diameter of the upper portion for landing on a tag shoulder in the housing;
a leg joined to and extending downward from an inner diameter of the upper portion, the leg having a lesser radial thickness than the upper portion, defining a downward facing shoulder in a plane perpendicular to the axis and located on a lower side of the upper portion;
a fillet joining the leg with the downward facing shoulder;
a leg rib on an inner diameter of the leg that initially abuts a lower surface of the body rib for preventing immediate downward movement of the hanger assembly relative to the actuator member as the actuator member shoulder lands on the tag shoulder; wherein
increased downward force on the hanger assembly after the actuator member shoulder has landed on the tag shoulder is adapted to cause the leg to elastically deflect, moving the leg rib radially outward from the lower surface of the body rib to enable the body rib to move downward past the leg rib to cause the load member to move into engagement with the housing assembly; and
a retainer ring secured to the hanger below the actuation member to retain the actuation member on the hanger.

19. The well system according to claim 18, wherein:
the retainer ring has a lower portion in physical engagement with the body and an upper portion comprising a cylindrical wall that extends around the leg of the actuator member.

20. The well system according to claim 19, wherein the cylindrical wall has a rim located below the downward facing shoulder of the actuator member.

21. The well system according to claim 20, wherein the retainer ring has an upward facing shoulder located at an upper end of the lower portion of the retainer ring and extending inward from a base of the cylindrical wall.

22. The well system according to claim 18, wherein the fillet has an upper portion that is at a higher elevation than the downward facing shoulder of the actuator member.

* * * * *